US008635712B1

(12) United States Patent
Steffanus

(10) Patent No.: US 8,635,712 B1
(45) Date of Patent: Jan. 28, 2014

(54) TANDEM WIND BREAKER

(76) Inventor: Eugene T. Steffanus, Coraopolis, PA (US)

( * ) Notice: Subject to any disclaimer, the term of this patent is extended or adjusted under 35 U.S.C. 154(b) by 183 days.

(21) Appl. No.: 12/660,375

(22) Filed: Feb. 25, 2010

Related U.S. Application Data

(60) Provisional application No. 61/209,129, filed on Mar. 4, 2009.

(51) Int. Cl.
*A41D 3/02* (2006.01)

(52) U.S. Cl.
USPC ..... 2/85; 2/69.5

(58) Field of Classification Search
USPC ..... 2/85, 86, 88, 89, 93, 69.5, 84, 214; 296/81, 78.1
See application file for complete search history.

(56) References Cited

U.S. PATENT DOCUMENTS

| | | | | | |
|---|---|---|---|---|---|
| 645,773 | A | | 3/1900 | Wolfgang | |
| 674,818 | A | | 5/1901 | Walbert | |
| 1,270,704 | A | | 6/1918 | Creery | |
| 1,802,807 | A | | 7/1929 | Davis | |
| 2,073,711 | A | * | 3/1937 | Robinsohn | 2/126 |
| 2,636,176 | A | * | 4/1953 | Ross | 2/93 |
| 2,959,789 | A | * | 11/1960 | Mills et al. | 2/93 |
| 4,347,629 | A | * | 9/1982 | Itoi | 2/108 |
| 4,476,587 | A | * | 10/1984 | Itoi | 2/94 |
| 4,773,102 | A | | 9/1988 | Curtis et al. | A41D 1/02 |
| 4,975,985 | A | * | 12/1990 | Stimpson | 2/115 |
| 5,052,738 | A | * | 10/1991 | Li | 296/78.1 |
| 5,384,915 | A | * | 1/1995 | Rodriguez | 2/93 |
| 5,389,430 | A | * | 2/1995 | Yilgor et al. | 442/76 |
| 5,526,532 | A | * | 6/1996 | Willard | 2/69 |
| 5,662,372 | A | * | 9/1997 | Lubkeman | 296/136.04 |
| D415,603 | S | | 10/1999 | Wampler | |
| 6,932,411 | B2 | | 8/2005 | McKinney | B60J 7/20 |
| D527,867 | S | | 9/2006 | Chase | |
| 7,458,104 | B1 | * | 12/2008 | Garcia | 2/69.5 |
| 7,574,751 | B2 | * | 8/2009 | Barreiro | 2/88 |
| 2004/0051336 | A1 | * | 3/2004 | Chiao et al. | 296/78.1 |
| 2004/0158910 | A1 | * | 8/2004 | Bay | 2/69 |

FOREIGN PATENT DOCUMENTS

| | | | | |
|---|---|---|---|---|
| CN | 2228280 | Y | 6/1996 | A41D 3/04 |
| CN | 2574438 | Y | 9/2003 | A41D 3/04 |
| CN | 201153525 | * | 11/2008 | |
| CN | 201185663 | * | 1/2009 | |
| JP | 09078315 | * | 3/1997 | |
| JP | 2005036372 | * | 2/2005 | A41D 13/00 |

* cited by examiner

*Primary Examiner* — Khoa Huynh
*Assistant Examiner* — Anna Kinsaul
(74) *Attorney, Agent, or Firm* — Ference & Associates LLC

(57) ABSTRACT

A novel tandem garment allows a motorcycle rider and passenger to relax from wind turbulence and cold and which further provides protection from the possible harmful effects of carbon monoxide from the internal combustion engine, including carbon monoxide poisoning. In one aspect, the novel two-person tandem garment includes zippers and hook and loop fastener strips used to secure the garment in high winds and/or high vehicle velocity. The break-away hook and loop is an important safety feature in the event of an accident. It has been found that the zippers and hook and loop fastener strips used to secure the garment protect the driver and passenger from exposure to carbon monoxide.

12 Claims, 6 Drawing Sheets

TANDEM WIND BREAKER

CLAIM FOR PRIORITY

This application claims the benefit of prior co-pending U.S. Patent Application Ser. No. 61/209,129, filed Mar. 4, 2009, which is hereby incorporated by reference.

TECHNICAL FIELD

This invention relates to an article of clothing and a method for use of the article of clothing. In one aspect, this invention relates to a method of making and manufacturing an article of clothing. In one aspect, this invention relates to an article of clothing, a method for use of the article of clothing, and a method of making and manufacturing an article of clothing for wear by two people on a moving vehicle. In one aspect, this invention relates to an article of clothing, a method for use of the article of clothing, and a method of making and manufacturing an article of clothing for wear by two people on an open motorcycle.

BACKGROUND OF THE INVENTION

Clothing provides protection from the elements of ambient conditions and weather when the elements of ambient conditions and weather are not hospitable or comfortable to the person wearing the clothing.

Motorcycle riders experience wind turbulence and loss of heat while riding.

It has been found that prior art clothing does not provide acceptable levels of protection from carbon monoxide and other harmful attacks on tandem motorcycle riders when riding in tandem.

The technology today for protecting motorcycle riders is flawed because riders are not protected from carbon monoxide.

U.S. Pat. No. 5,052,738 discloses a shading cover for motorcycles which provides a box, a winding device, and a canvas. The cover is designed to accommodate two riders. The canvas is rolled up onto the reel, and has a long flexible band sewn on the lower edge of the canvas, a long zipper with an additional canvas piece sewn on the upper front of the canvas, two short zippers with bags and rain hats sewn on the upper middle part of the canvas, and two canvas sleeves with short flexible bands placed on both sides of the canvas so that the canvas can be used as a sun shade and a raincoat.

U.S. Pat. No. 5,662,372 discloses a flexible weather protective vehicle cover structure including a vehicle cover section sized and positionable to cover the motorcycle-like vehicle for protectively covering a stationary at least two-wheeled motorcycle-like vehicle with and without a rider thereon. VELCRO hook and loop fastener material is used to secure the cover (see Col. 4, line 33).

U.S. Pat. No. 6,932,411 discloses a garment for occupants of personal recreation vehicles. The garment that attaches to the body of a personal recreational vehicle preferably covers substantially all of the wearer's body and traps heat generated and lost by the vehicle engine. VELCRO hook and loop fastener material can be used to secure the garment (see Col. 3, line 4-6).

U.S. Pat. No. 5,384,915 discloses an outer garment to be worn by one or more people together, having an outer jacket with a pair of sleeves, and an inner jacket portion with one sleeve. The outer jacket and inner jacket are partially connected at the neck opening and partially connected at the waistband. The garment is convertible from an unexpanded configuration wearable by one person to an expanded configuration wearable by at least two people. In the unexpanded configuration, the one sleeve of the inner jacket portion is inserted by the wearer into one of the sleeves of the outer jacket. To change to the expanded configuration, a securing feature on the back of the outer garment is released allowing additional folded material to be unfolded into an expanded back portion. In addition in another embodiment when an inner panel is attached to the back portion of the outer jacket, two people can both be separately enveloped in their own garment. The expandable feature allows for ease of movement by the people wearing the garment. When worn by two caring people, they can enjoy close physical contact and embrace each other while wearing the garment. The garment is designed for warmth and also is adaptable to different-sized people. VELCRO hook and loop fastener material can be used to secure the garment (see Col. 4, line 45).

U.S. Pat. No. 4,773,102 discloses an outer garment to be worn by two persons together, consisting of a vest, two sleeves, and two inner arm support compartments. The garment can be a closed vest having a means of access for the head at the top, or having a front opening extending from top to bottom, having a first section and a second section with a means of closure. The inner arm support compartments afford the wearers comfort and wearing versatility, while allowing the two wearers to maintain close physical contact. VELCRO hook and loop fastener material can be used to secure the garment (see Col. 2, line 45).

U.S. Design Pat. D415,603 discloses a mom and tot hair-cutting cape. The cape is configured and designed so that the openings for the heads are in "single-file" alignment as would be used on a motorcycle.

U.S. Pat. Nos. 645,773; 674,818; 1,802,807; and Design Pat. D527,867 each disclose a garment for two people in a vehicle. The garments all are configured so that the people sit side-by-side similar to riders of "trikes."

U.S. Pat. No. 1,270,704 discloses a cycle raincoat and cover. The garment uses buttons and other fastening means. Zippers do not appear to be used in the garment.

Chinese patent CN2574438Y entitled "Two head motorcycle raincoat" in the machine translation of the abstract reads:

> The raincoat which this model utility involves one kind rides when motorcycle to put on (or is called rain cape). Including two foreheads, first piece and latter piece. Before using the piece, the first piece lower extremity's about two angles subscribe against flutter clamp, two edges sew separately support by hard and stubborn effort the bag, increases the files rain area, the rain water cannot flutter the wet bottom of pants leg. The first piece's lower part opens has thoroughly the smooth hole, in passes the smooth hole about place above to sew two vertical reflector covers, the rain water cannot flow in the raincoat from the reflector mouth, will not drip wet the glove and the bottom of pants leg, the rainproof effect will be better.

Chinese patent CN2228280Y was published in 1996 entitled "One or double people raincoat" in the machine translation reads as follows:

> This model utility may supply or two people ride a bicycle when to use, usually may supply one person to use. When before, on the piece child rain cape will pull up, then supplies at the same time two people rainproof. Moreover, before this rain cape, the piece is long, and has buckles with the buckle, may fix it on the bicycle front fork, prevents the rain water to drip wet the riding a bicycle person's pants.

SUMMARY OF THE INVENTION

The article and method of the present invention provide a special garment for allowing a motorcycle rider and passenger to relax from wind turbulence and cold and which further provide protection from the possible harmful effects of carbon monoxide, including carbon monoxide poisoning by carbon monoxide from the internal combustion engine.

In one aspect, the article and method of the present invention provide a novel two-person tandem garment for use by motorcyclists. In one aspect, the novel two-person tandem garment includes hook and loop strips used to secure the garment in high winds and/or high vehicle velocity. The break-away hook and loop fastener is an important safety feature in the event of an accident.

DETAILED DESCRIPTION

Figure 1:
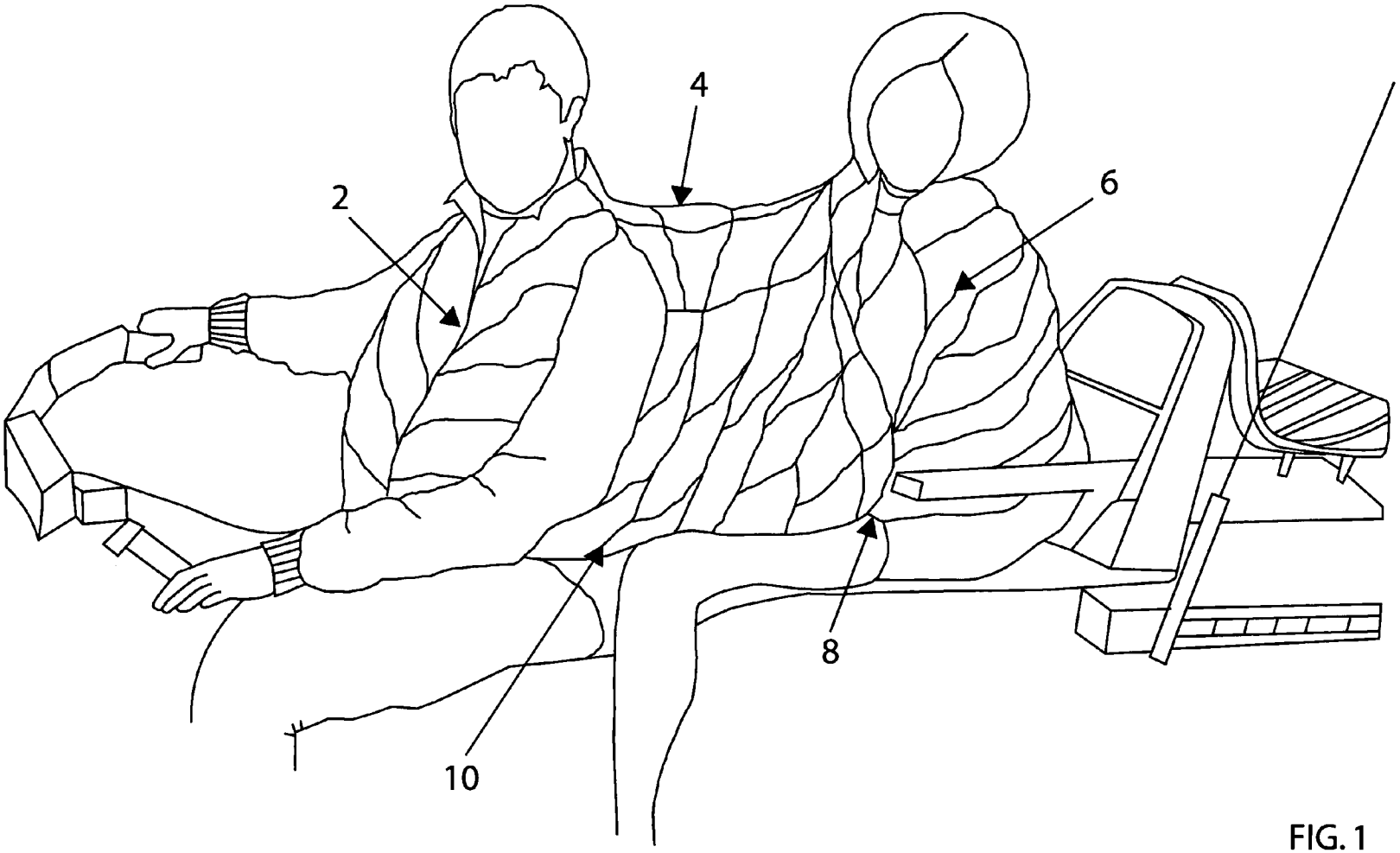
FIG. 1 shows a side perspective view of the tandem clothing article of the present invention.

The present invention includes a novel clothing article and novel method for providing and using the novel clothing article while riding a motorcycle or open air vehicle. In one aspect, the article and method of the present invention provide a novel two-person tandem garment for use by motorcyclists or open air vehicles such as ATV's (all terrain vehicles) or snowmobiles or any vehicle wherein the riders are exposed to the wind or elements of weather. A windbreaker and extension are adapted to encompass two persons, whereby the first person operates the motorcycle or open air vehicle and the second person holds onto the first person operator. No barrier (FIG. 3, (12)) separates the two persons on the motorcycle or open air vehicle. The article and method of the present invention provide a special garment in the form of a tandem wind breaker sewn together and worn by two motorcycle riders in the manner of a wind breaker.

The article and method of the present invention remove wind resistance, thereby protecting against wind turbulence. Riders thereby are able to conserve body heat and further are able to communicate better. With the removal of the wind turbulence being accomplished, higher fuel conservation is achieved, and motorcycle fuel savings and mileage in miles per gallon are increased.

The article and method of the present invention provide an enclosure occupied by two persons on the motorcycle and protects them from the elements, taking them out of the existing ambient weather conditions. Communication between the two persons is improved while riding on the motorcycle.

The new article has a structure formed from fabric or clothing material. Preferably, the new article has a structure formed from nylon. In one aspect, the new article has a structure preferably formed from leather.

The article and method of the present invention provide a special garment for allowing a motorcycle rider and passenger to relax from wind turbulence and cold and which further provides protection from the possible harmful effects of carbon monoxide, including carbon monoxide poisoning. The carbon monoxide generated from the internal combustion engine is dissipated into the atmosphere rather than reaching the driver and passenger on the motorcycle. The tandem wind breaker of the invention has been found to protect both occupants from air pollution and from being overcome by carbon monoxide or any other vapors generated by the vehicle being ridden or by other vehicles on the road. The tandem wind breaker protects both occupants from air pollution and from being overcome by carbon monoxide by being totally removed from the vapors generated by the internal combustion engine. In this same light, the chance of fire generated by the engine exhaust is eliminated.

In one aspect, the novel two-person tandem garment includes VELCRO hook and loop fastener material strips used to secure the garment in high winds and/or high vehicle velocity. The break-away VELCRO hook and loop fastener material is an important safety feature in the event of an accident.

Referring now to FIG. 1, a side perspective view shows the tandem clothing article of the present invention. Water resistant zipper 2 allows entry into the article and also provides a ventilation point. Wind breaker 4 provides a one-piece waterproof and wind proof wind breaker in tandem design in accordance with the present invention. VELCRO hook and loop fastener material seam 6 provides for break away in the event of an accident. Because of the hook and loop fastener seam 6, the passenger will not be taken with the driver. Adjustable waist band 8 accommodates any average passenger. Adjustable waist band 10 accommodates any average driver. Materials used for the tandem wind breaker of the present invention include materials to form a structure having the characteristics of a structure formed from fabric or clothing material. Preferably, the new article has a structure formed from nylon.

In one aspect, the new article has a structure preferably formed from leather. The tandem wind breaker of the present invention is sewn together using conventional sewing techniques to combine the elements of the tandem wind breaker of the present invention.

Figure 2:
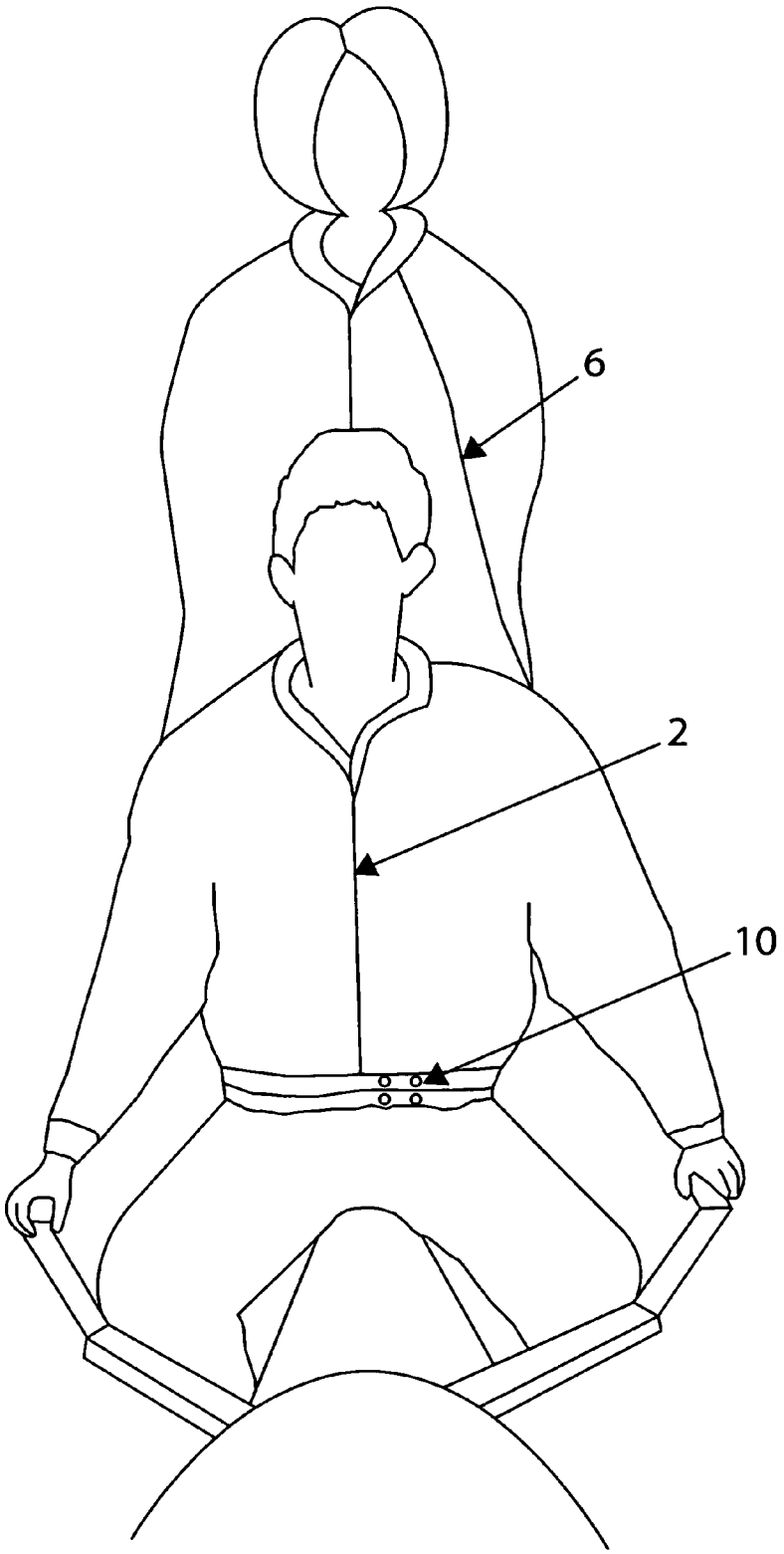
FIG. 2 shows a front perspective view of the tandem clothing article of the present invention.

Referring now to FIG. 2, a front perspective view shows the tandem clothing article 4 of the present invention. The zipper 2, hook and loop fastener seam 6, and adjustable waist band 10 are shown from the front view.

Figure 3:
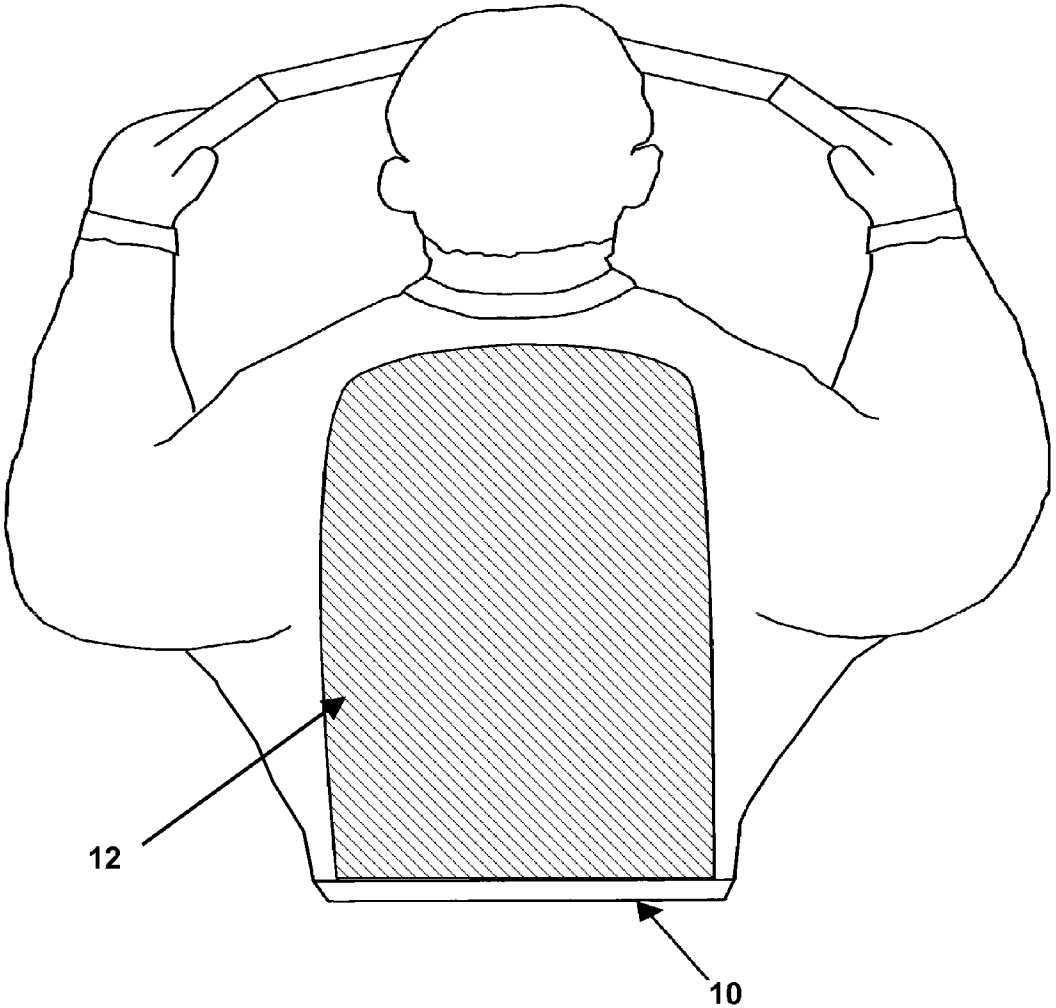
FIG. 3 shows a posterior perspective view of the driver portion of the article of the present invention.

Referring now to FIG. 3, a posterior perspective view shows the driver portion of the tandem wind breaker article 4 of the present invention. The adjustable waist band 10 is shown from the aft or posterior view.

Figure 4:
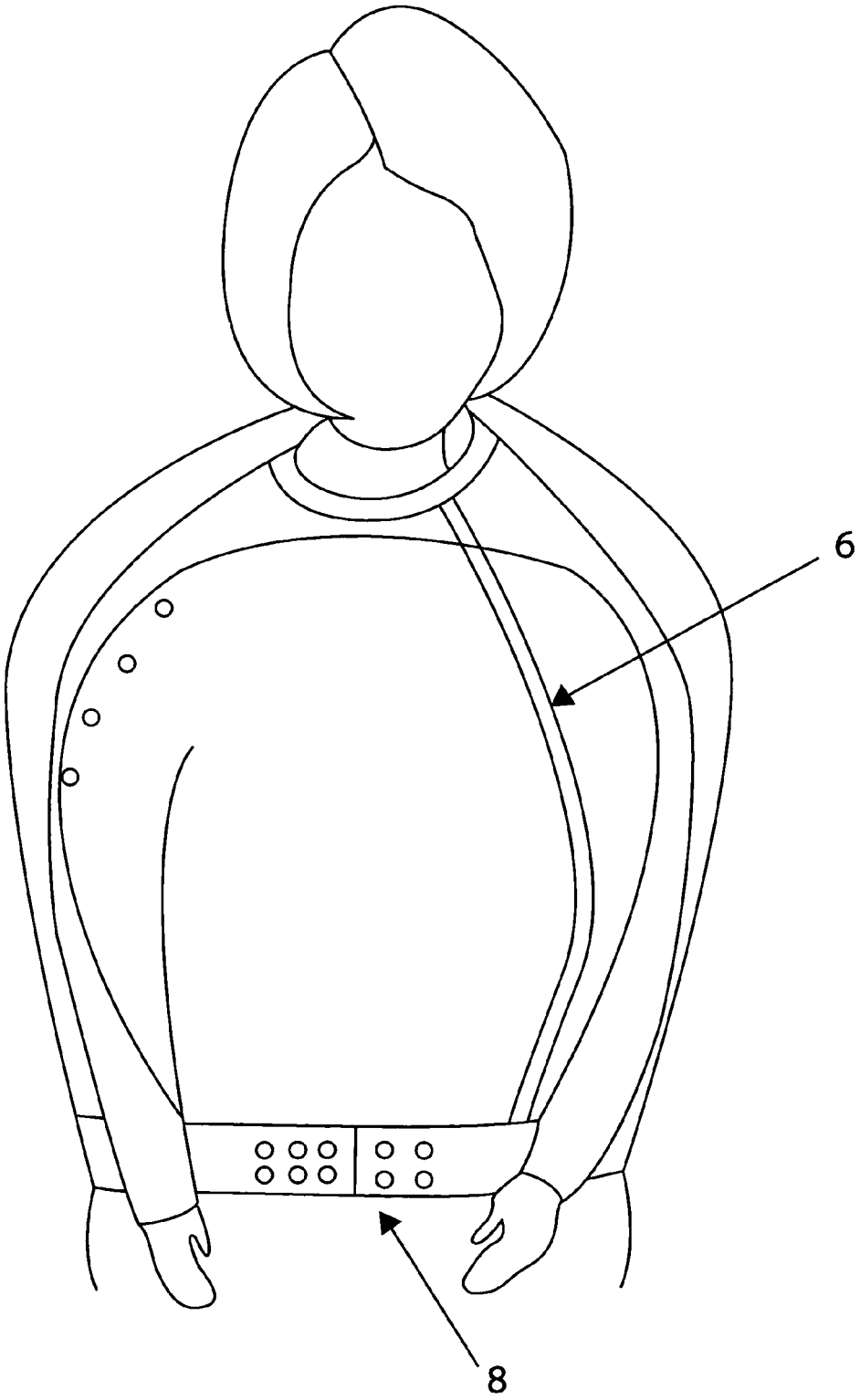
FIG. 4 shows a front perspective view of the passenger portion of the article of the present invention.

Referring now to FIG. 4, a front perspective view shows the passenger portion of the tandem wind breaker article 4 of the present invention. The hook and loop fastener seam 6 and adjustable waist band 8 are shown from the front view.

Figure 5:
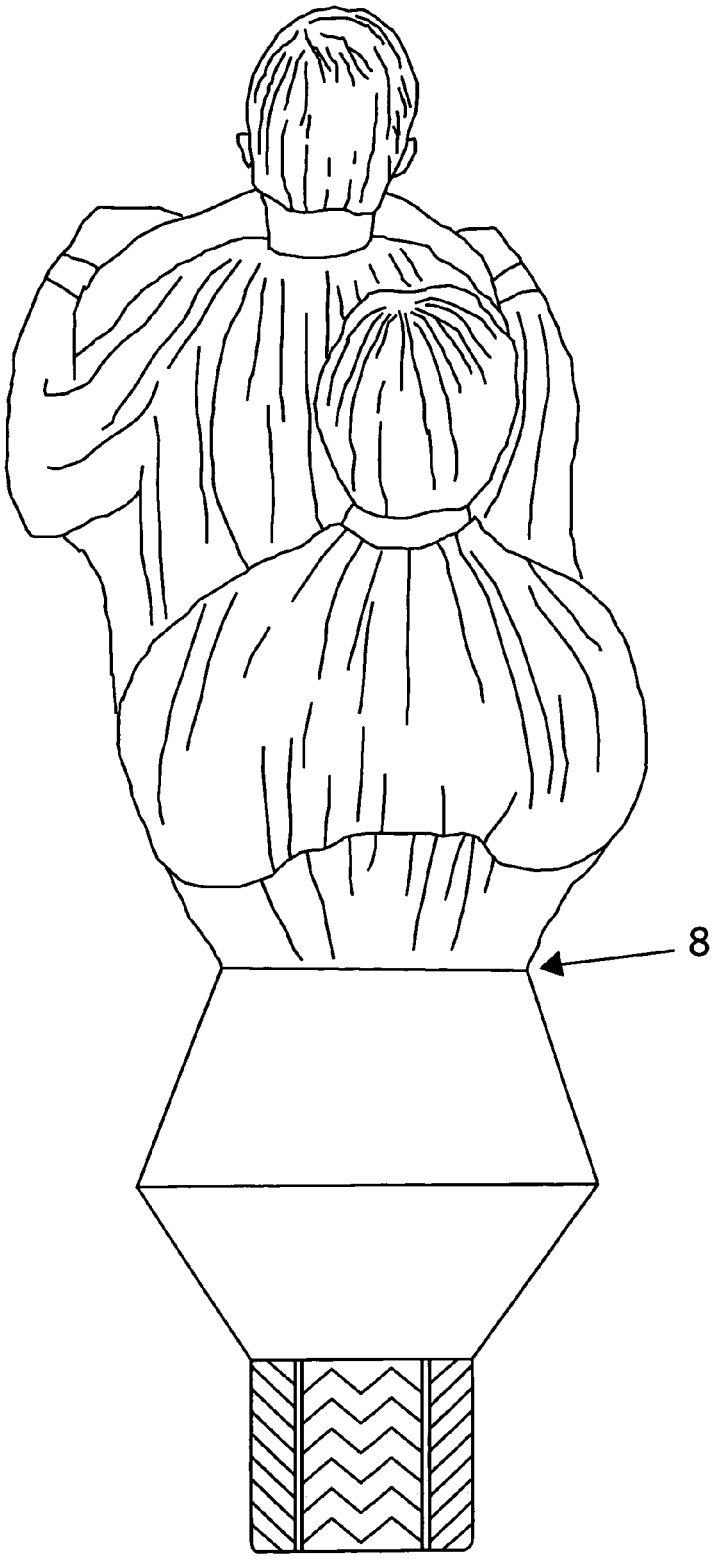
FIG. 5 shows a posterior perspective view of the tandem clothing article of the present invention.

Referring now to FIG. 5, a posterior perspective view shows the tandem clothing article 4 of the present invention. The adjustable waist band 8 is shown from the aft or posterior view.

Figure 6:
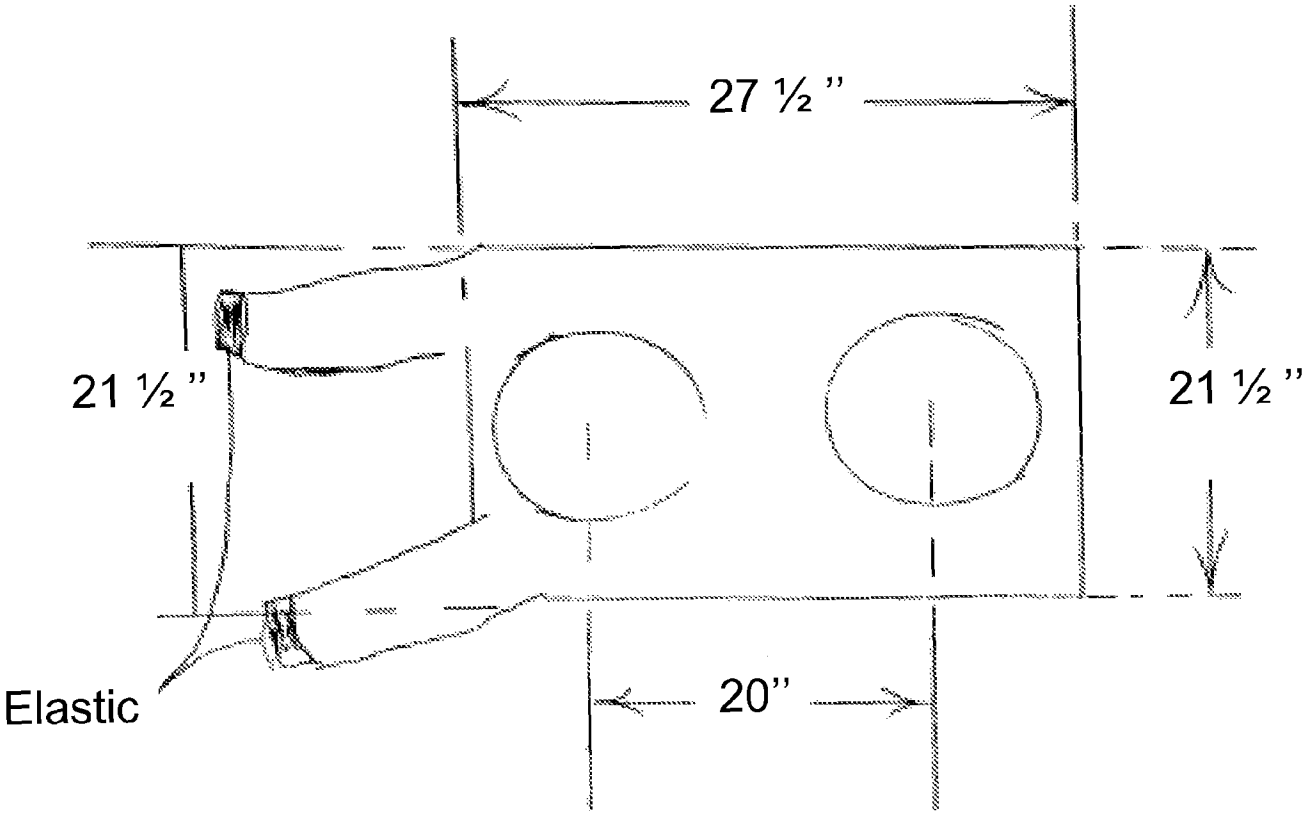
FIG. 6 shows a plan view of the tandem clothing article of the present invention.

FIG. 6 shows a plan view of the tandem clothing article of the present invention.

It has been found from actual empirical testing that the tandem wind breaker of the present invention works well to provide substantial wind resistance to the riders, protection from the outside elements of rain and cold, and further provides higher gas mileage.

The present invention has been found to provide protection from flying insects such as wasps, bees, and hornets. These poisonous flying insects distract the vehicle operator from concentrating on the road and thereby create a potentially dangerous incident and possibly an accident.

The tandem wind breaker of the present invention adds a substantial degree of safety to the operation of any open air motor vehicle, whether it is operated on land or snow or water or on the open road. An improved gas mileage is a further benefit and advantage.

The tandem wind breaker of the present invention provides an escape from the effects of wind burn and protects the riders from carbon monoxide. The tandem wind breaker removes the riders from exposure to the gases or discharges from the internal combustion engine. The tandem wind breaker removes the riders from exposure to the gases or discharges from the internal combustion engine thereby diminishing the fear of fire. In the tandem wind breaker, the occupants enjoy a ride in comfort away from the ambient weather systems. Gas economy is increased.

The invention is described in conjunction with several preferred embodiments. Persons skilled in the art understand that changes and variations can be made in light of the foregoing detailed description. The invention embraces all such changes and variations falling within the spirit and scope of the following claims.

In the foregoing specification and in the figures of the drawings, a detailed description has been provided and set down and further includes specific embodiments of the present invention for the purpose of illustration. In respect to the figures of the drawings of the specification of the present invention, like items are identified by like numerals. As the invention has been illustrated by the preceding detailed description and in the figures of the drawings, the article and method of the present invention are not intended to be construed as being limited to the specific examples of the preferred embodiments. Variations may be made to include aspects of the complete disclosure as set forth in the figures of the drawings and in the detailed description without departing from the scope of the invention as disclosed in the specification and as defined in the appended claims which follow.

The article and method of the present invention are not intended to be limited to the descriptions of specific embodiments herein above, but rather the article and method of the present invention should be viewed in terms of the complete specification and claims which follow and equivalents thereof.

What is claimed is:

1. An article of clothing, comprising: a tandem wind breaker having a material construction for accommodating two people in tandem, said material construction comprising:

a driver portion; a passenger portion; and a third portion;

said driver portion including:

a zipper corresponding to a first collar defining a first opening, said zipper providing entry into the article and also providing a ventilation point;

an open back portion formed in said driver portion such that no material barrier exists between said driver portion and said passenger portion;

a pair of sleeves attached to said driver portion; and a first adjustable waistband of said driver portion;

said driver portion having material construction extending from said first adjustable waistband to said first collar, wherein said material construction is designed to only extend to said first adjustable waistband;

said passenger portion including:

a second collar defining a second opening;

a second adjustable waistband of said passenger portion; and a first side of a hook and loop fastener;

said passenger portion having material construction extending from said second adjustable waistband to said second collar, wherein said material construction is designed to only extend to said second adjustable waistband; and the third portion including:

a wind breaker portion having material extending between said driver portion and said passenger portion and forming a front of said second passenger portion;

said wind breaker portion forming a back of said driver portion and substantially enclosing said open back portion;

said wind breaker portion including a second side of the hook and loop fastener;

said hook and loop fastener forming a seam traversing an area bounded by the second adjustable waistband and the second collar;

wherein said driver portion, said passenger portion and said third portion cooperate to form the tandem wind breaker when said first side of the hook and loop fastener and the second side of the hook and loop fastener are secured to one another to form a seam sealing an enclosure between the driver portion and the passenger portion, said enclosure being covered by material of the wind breaker portion and being devoid of material internal thereto such that access extending between the passenger portion and the driver portion is permitted via at least the open back portion formed in the driver portion.

2. The article of clothing of claim 1, wherein said material construction of the wind breaker provides waterproof and windproof characteristics to the tandem wind breaker.

3. The article of clothing of claim 1, wherein said zipper comprises a waterproof zipper.

4. The article of clothing of claim 1, wherein said first side of said hook and loop fastener and said second side of said hook and loop fastener cooperate to form said seam on one side of the passenger portion to accommodate entry of a passenger to the tandem wind breaker.

5. The article of clothing of claim 1, wherein at least a portion of said tandem wind breaker is composed of nylon.

6. The article of clothing of claim 4, wherein the passenger portion is formed such that egress from the passenger portion by a passenger may be accomplished through an opening provided by separating the seam.

7. The article of clothing of claim 1, wherein said seam terminates at a lower side of said seam anterior to said second adjustable waistband.

8. The article of clothing of claim 1, wherein a front surface of said driver portion and a rear surface of said passenger portion are approximately 27½ inches apart.

9. The article of clothing of claim 1, wherein an inter-collar distance between the first collar and the second collar is approximately 20 inches.

10. The article of clothing of claim 1, wherein the pair of sleeves attached to said driver portion are the only sleeves included in the article of clothing.

11. The article of clothing of claim 1, wherein the article of clothing has a length dimension of approximately 27½ inches and a width dimension of approximately 21½ inches.

12. The article of clothing of claim 1, wherein the zipper corresponding to a first collar bisects a front surface of said driver portion and terminates proximate to the first adjustable waistband and wherein the seam runs from the second collar to the second adjustable waistband.

* * * * *